United States Patent [19]

Abel

[11] 4,028,157

[45] June 7, 1977

[54] METHOD AND APPARATUS FOR MOVING AND GUIDING WIRES

[75] Inventor: Martin L. Abel, Franklin, Mich.

[73] Assignee: Permalock Company, Inc., Auburn Heights, Mich.

[22] Filed: June 6, 1975

[21] Appl. No.: 584,521

Related U.S. Application Data

[63] Continuation-in-part of Ser. No. 323,440, Jan. 15, 1973, Pat. No. 3,915,789.

[52] U.S. Cl. ..... 156/72; 156/435

[51] Int. Cl.² ..... D05C 15/00

[58] Field of Search ..... 156/72, 435, 179, 200, 156/199, 201, 204, 210, 205, 324, 434, 439, 440, 474, 479, 471; 270/61 F, 61 R, 66, 78, 86; 226/113, 158, 120; 217/18, 20

[56] References Cited

UNITED STATES PATENTS

| | | | |
|---|---|---|---|
| 2,685,357 | 8/1954 | Koreska | 197/168 |
| 2,874,408 | 2/1959 | Vicli et al. | 156/474 |
| 3,127,293 | 3/1964 | Trenteseaux | 156/474 |
| 3,627,306 | 12/1971 | Affupper | 270/79 |
| 3,657,052 | 4/1972 | Debonnet | 156/435 |
| 3,691,069 | 9/1972 | Walsen | 156/72 |
| 3,785,906 | 1/1974 | Fay | 156/435 |
| 3,790,426 | 2/1974 | Bylund | 156/435 |

*Primary Examiner*—Charles E. Van Horn
*Assistant Examiner*—Michael W. Ball
*Attorney, Agent, or Firm*—Lane, Aitken, Dunner & Ziems

[57] ABSTRACT

Apparatus and method for moving a pair of elongated members to engage and fold a length of flexible material into a series of loops. The apparatus includes moving means for moving both elongated members simultaneously on each side of the flexible material along first predetermined paths and translating means for translating the movement of the portion of each elongated member that engages the flexible material from its first predetermined path to a second predetermined path so that the elongated members will alternately engage the flexible material and urge it back and forth to form the series of loops.

28 Claims, 36 Drawing Figures

FIG. 7.
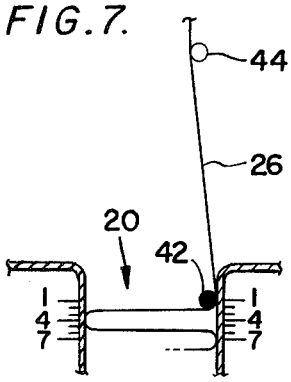
FIG. 8.
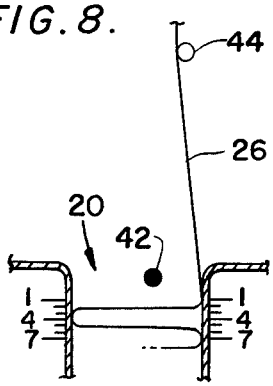
FIG. 9.
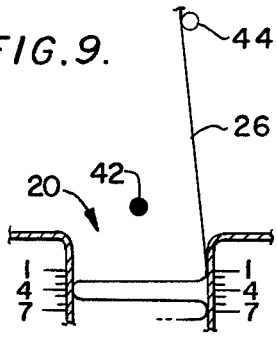
FIG. 12.
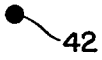
FIG. 10.
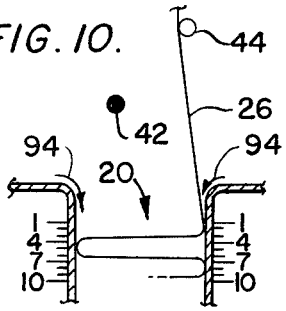
FIG. 11
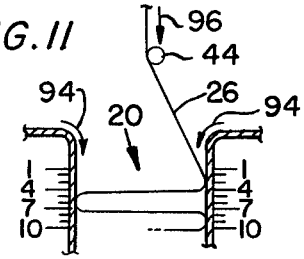
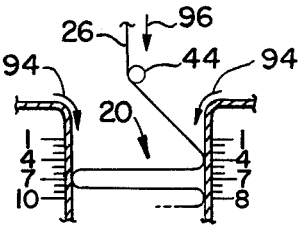
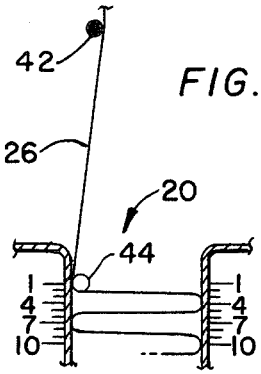
FIG. 13.
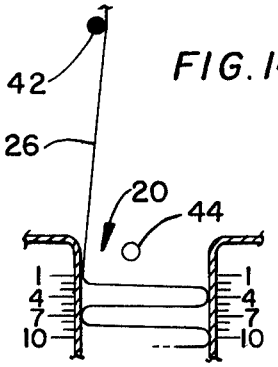
FIG. 14.
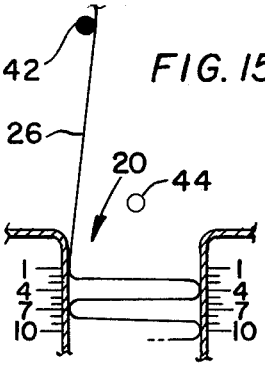
FIG. 15.
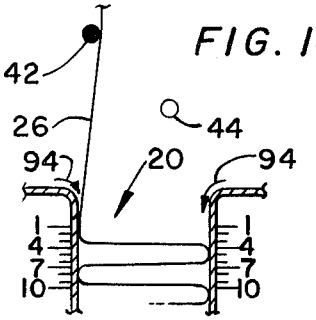
FIG. 16.
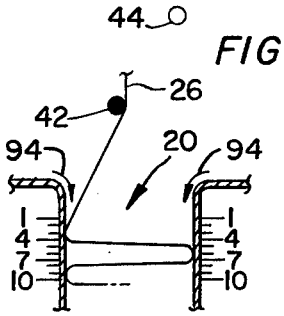
FIG. 17.
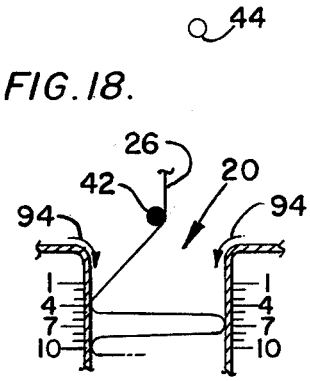
FIG. 18.
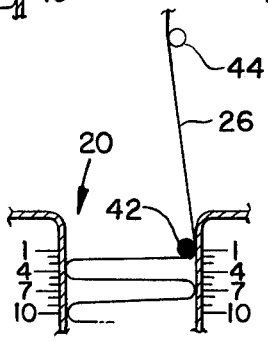
FIG. 19.

METHOD AND APPARATUS FOR MOVING AND GUIDING WIRES

This application is a continuation-in-part of my copending application, Ser. No. 323,440, filed Jan. 15, 1973, now U.S. Pat. No. 3,915,789 which describes and shows a unique yarn folding mechanism that is used in the manufacture of bonded carpeting.

BACKGROUND OF THE INVENTION

This invention relates to machines for making non-woven bonded carpeting or the like which utilize a pair of elongated members or wires that are moved back-and-forth to fold a plurality of strands of yarn into an accordion-like chain and in one embodiment plant them in an adhesive coating on opposing backing layers and, more particularly, to the portion of such a machine that moves and guides the wires along predetermined paths to effect the folding and planting of the yarn.

The yarn is folded by means of wires held in tension and moved at their ends, which has proven to be a significant advance in the art of making bonded carpeting. Traditionally, such carpet has been formed by the use of elongated blades that extend across the entire width of the machine. These blades are heavy and cumbersome, which requires complicated, expensive and space-consuming components located above the machine so that the blades can be moved to perform the folding and planting operation. In addition, a great amount of energy is required to operate the machine because of the large number of moving parts and their relatively large size. The nature of those machines also limit their operational speed.

The wires described in my pending application have solved those problems. However, although the mechanism shown for holding and enabling the wires to move along their predetermined paths proved workable and offered great advantages over the prior art, it utilized a relatively large number of moving parts by providing means for moving each wire independent of the other one, which contributed to preventing the wires from moving at their potential maximum speed.

In addition, the means used for translating the outer orbital movement of the wires into the non-orbital movement used for folding and planting the yarn was found to limit the speed by which the wires were made to move.

SUMMARY OF THE INVENTION

In accordance with the invention, a spindle and cam mechanism for rotating and translating the rotational movement into the folding and planting movement of the wires is provided which represents a significant improvement over the mechanism used to perform the same function in the machine in my copending application.

In place of the double spindle at each end of the wires comprised of independently rotatable members that enabled each wire to be rotated independent of the other one, a single spindle is provided to which the ends of both wires are connected. The wires are spaced apart at a predetermined angle (preferably 180°) and by moving the wires in conjunction with the cam means, in a manner which will be discussed in detail below, both wires can be moved simultaneously by the single spindle and still be moved along their predetermined folding and planting paths. In addition, the wires are attached to each spindle by a specially designed holder which can easily be used to adjust the tension in the wires and which enables a wire to be replaced quickly if needed.

The cam mechanism includes a pair of guide plates at each end of the wires which can be moved back-and-forth into and out of engagement with the wires to translate the orbital movement of the wires into their non-orbital folding and planting movement. Two stationary cam surfaces are also provided for guiding the wires and insuring that while the outer ends of the wires are being moved along their orbital paths the portions of the wires that engage the yarn will not interfere with the yarn or rub against the adhesive coated on the backing material during certain stages of the folding and planting cycle.

By providing the single spindle arrangement for moving the wires through their orbital paths, two stepping motors are eliminated and the complicated structure of the spindle with the independently rotatable sections is no longer necessary. All that needs to be done now is to move the single spindle through a predetermined program in order to provide the wires with the necessary orbital motion. By coordinating movement of the guides with the movement of wires, the cam surfaces of thsoe guides in conjunction with the two stationary cam surfaces operate to translate the outer orbital movement of the wires into their predetermined non-orbital paths to effect the folding and planting movement that is used to form the non-woven bonded carpeting.

By eliminating the motors and mechanisms described above, the machine is made much less complicated structurally, thereby reducing the possibility of breakdown. In addition, the speed of the wires is increased significantly which results in greater production for the machine and consequently a cost savings.

BRIEF DESCRIPTION OF THE DRAWINGS

For a better understanding of the invention, reference may be had to the following description of an exemplary embodiment of the invention taken in conjunction with the accompanying drawings in which:

FIGS. 7–19 correspond to the positions of wires and cam surfaces shown in FIGS. 20–32, respectively, and are schematic views of the wires moving through their non-orbital paths relative to the position of the yarn and showing how the folding and planting steps take place;

DETAILED DESCRIPTION OF AN EXEMPLARY EMBODIMENT

Figure 1:
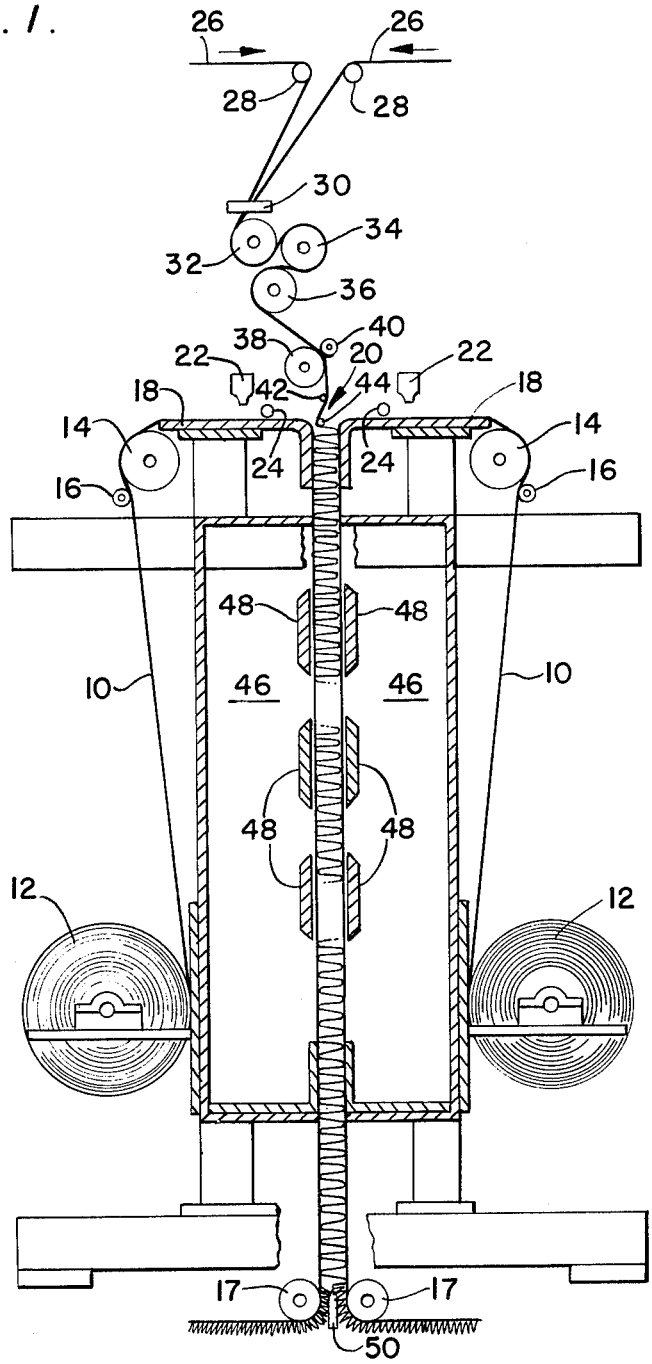
FIG. 1 is a front view, partially in section, of the carpet machine showing in particular the path of movement of the yarn and backing material and the well of the machine where the planting of the yarn takes place in order to form the yarn sandwich.

An exemplary embodiment of the wire moving and guiding mechanism will now be described in conjunction with the type of machine for making non-woven carpeting described and shown in my copending application, Ser. No. 323,440, filed Jan. 15, 1973. This machine, as shown in FIG. 1, continuously advances two layers of backing material 10, which are unwound from the rolls 12. The backing material can be formed of continuous webs of jute or of a synthetic polymeric material such as the unwoven polyester produced by DuPont with the trade-name Remay. Other suitable types of backing material can also be used.

The backing layers 10 are pulled from the rolls 12 and advanced by the incrementally driven rollers 14, each web of the backing material 10 moving between the drive rollers 14 and the idler roller 16 which urges the backing material 10 against the drive roller 14 to provide frictional contact for advancing the backing material 10. The drive rollers 17, located at the bottom of the machine, both have a plurality of small pins projecting from their outer surfaces, the pins engaging the backing material 10 for pulling it through the machine. A third drive roller (not shown) operating in conjunction with two other rollers is located on each side of the machine for winding the finished carpet into rolls. Adjustable stepping motors (not shown) are used to rotate all of the drive rollers mentioned above in incremental fashion so that the layers of backing material 10 are advanced step-by-step for reasons which will be explained in more detail below. The stepping motor for each drive roller is synchronized with the other ones by a central computer, which also operates to synchronize those stepping motors with all the other moving parts of the carpet making machine, as will be discussed in detail below.

The layers of backing material 10 are advanced across the guides 18 which comprise a flat horizontal surface integral with a flat vertical surface, the vertical surfaces facing each other to form a well 20 between them. As the layers of backing material 10 move across the horizontal surfaces of the guide 18, a layer or adhesive such as polyvinylchloride (PVC) is applied to the outer surfaces of the layers 10. The PVC can be supplied from a remotely located reservoir or drums (not shown) to a plurality of nozzles 22 which are spaced apart across the entire width of the layers of backing material 10. The PVC can be extruded from the nozzles 22 in the intermittent "puddles" or in a continuous stream. The doctor blades or pipes 24 are used to spread the PVC so that a uniformly thin layer is provided across the entire width of the backing material.

Figure 6:
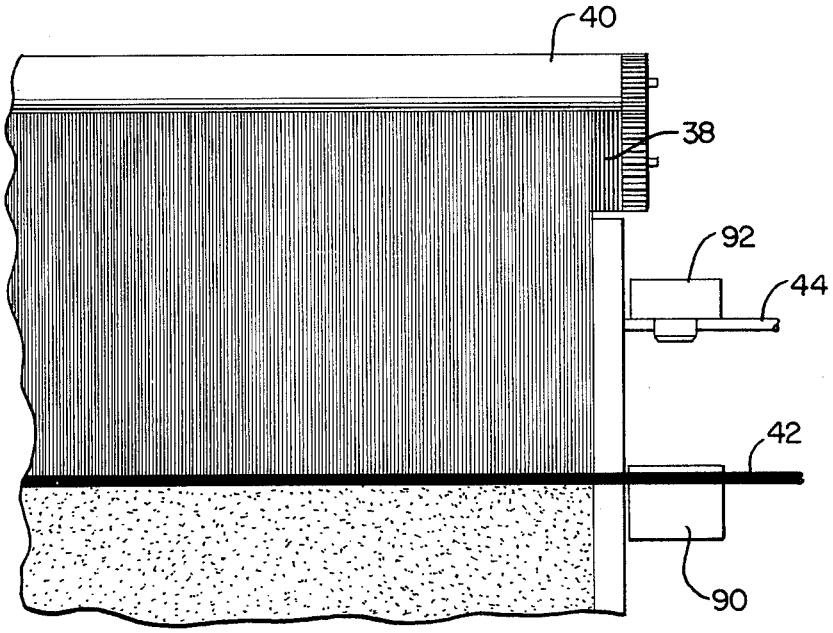
FIG. 6 is a sectional view of one end of the well looking along the line 6—6 in FIG. 3 and showing in particular the stationary cam surfaces which cooperate with the guides to translate the orbital movement of the wires into their non-orbital movement.

As the layers of backing material 10 coated with the PVC advance into the well 20, the strands of yarn 26 are also advanced. The strands of yarn 26 are pulled from a plurality of spools or beams located on either or both sides of the machine (not shown). The yarn travels over the stationary pipes 28 along the direction of the arrows and through the comb 30 which is provided to maintain the yarn 26 in proper alignment. The yarn 26 then travels around the rollers 32, 34 and 36, all of which frictionally engage the yarn 26 and are geared together at one or both ends, the roller 34 being driven by a stepping motor similar to the ones used to advance the sheets of backing material 10. The yarn 26 then travels over the roller 38, which is a roller formed with a plurality of grooves spaced apart parallel to each other across its outer surface. Each groove accomodates one strand of yarn and operates to maintain the proper alignment of the strands as they are being advanced into the well 20. A nip or push roller 40 abuts the comb roller 38 in order to keep each yarn in its own groove and prevents the yarn from slipping out of the grooves. The comb roller 38 is driven either by its own stepping motor or by the one that drives the rollers 32, 34 and 36. The comb roller 38 and nip roller 40 are geared together at one or both ends so that they can move simultaneously with each other, as shown in FIG. 6.

As the layers of backing material 10 coated with the PVC advance into the well 20, the strands of yarn which extend in a row across the entire width of the backing layers are folded and planted in accordion-like fashion between the opposing layers of backing material 10. A pair of wires 42, 44, are utilized to perform this folding and planting process, and movement of the wires in conjunction with the wire moving and guiding mechanism which is the subject of this invention will be described in detail below.

After the layers of backing material 10 have been connected by the accordion-like chains of yarn 26 to form what is known as a "yarn sandwich", the sandwich is advanced into the oven 46 where heat is applied by any suitable heating means such as those shown schematically and designated by reference numeral 48. The heat cures the PVC and anchors the yarn firmly in place. The connected layers of backing material 10 then move out of the oven 46 to a cutter which is shown schematically in FIG. 1 and designated by reference numeral 50. The cutter 50 is preferably in the form of an endless belt bandsaw which operates to sever the yarn 26 between the layers of backing material 10 to form two separate carpets. The carpets are then rolled up into the final product.

The wire moving and guiding mechanism that will be described below can also be used in conjunction with other types of machines for manufacturing non-woven bonded carpeting such as, for example, where the mechanism is used just to fold the strands of yarn to form a plurality of accordion-like chains and the PVC or other adhesive is applied to one or both of the outer surfaces of the chain after the folding process has taken place.

Figure 2:
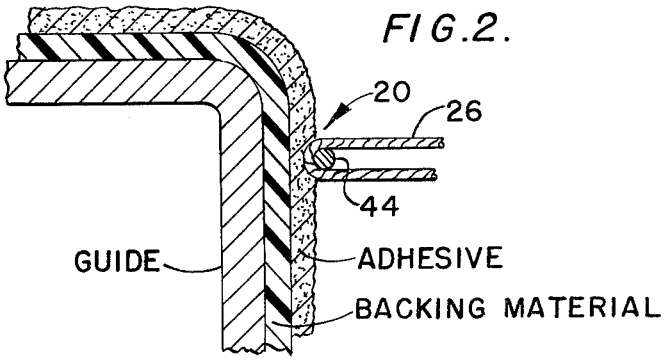
FIG. 2 is an exaggerated sectional view of one of the wires planting a strand of yarn in the adhesive coating on a sheet of backing material.

As mentioned briefly above, the folding and planting of the strands of yarn 26 are accomplished by means of a pair of wirs 42, 44, which engage the yarn and alternately push it into the PVC on one layer of backing material 10 and then into the PVC on the other layer of backing material 10. As shown best in the exaggerated view in FIG. 2, the planting takes place a short distance below the upper edge of the well 20.

Each of the wires 42, 44, is tensioned between wire holding and moving means located outside the well 20 on both sides thereof, which will be described in detail below. The wires 42, 44, extend across the entire width of backing material 10 and are preferably formed of stainless steel and have a diameter about 1/16 of an inch.

Figure 3:
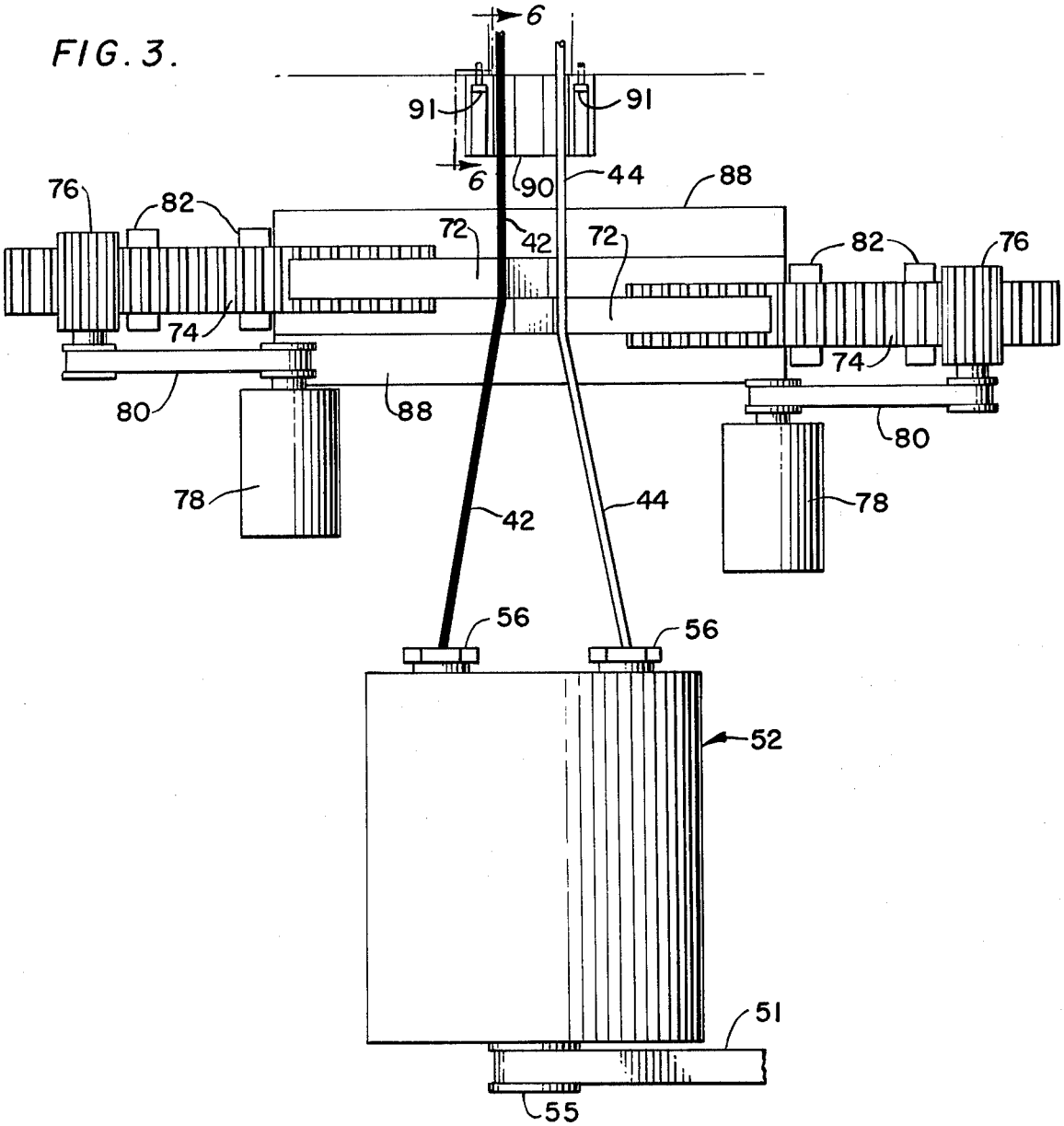
FIG. 3 is a top view of one end of the well of the machine showing in particular the single spindle holding both wires and the movable guides which translate the orbital movement of the wires into their non-orbital movement.
Figure 3A:
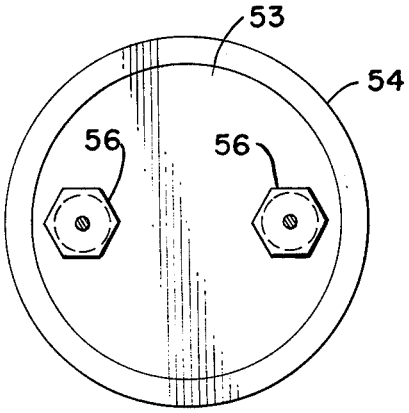
FIG. 3A is an end view of the spindle.

As shown in FIG. 3, at each end of the well 20, the ends of the wires 42, 44, are both connected to a single spindle 52 which is driven by a stepping motor (not shown) through either the belt 51 or a gear mechanism (not shown). The wires 42, 44, are connected at points an equal distance from the axis of the spindle 52 and spaced 180° apart from each other, as shown best in FIG. 3A. The spindle 52 comprises an inner rotatable portion 53 mounted for rotation within the housing 54, an appropriate bearing connection being made between them. A pulley 55 is attached to the rotatable portion 53, which operates to turn the rotatable portion by means of the belt 51. In this way, when the inner portion 53 is rotated within the housing 54 the wires 42, 44, will move in an identical orbit or circle. Alternatively, the wires could be spaced at other angles from each other such as, for example, 90° and the orbital paths of the wires could be at different distances from the axis.

Figure 4:
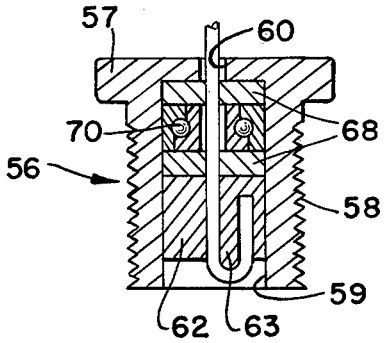
FIG. 4 is a sectional view of the holder which is used to attach the ends of the wires to the spindles.

The wires 42, 44, are attached to the spindle 52 by means of the holder or plug 56 shown in FIG. 4. The plug 56 comprises a hexagonal head portion 57 and an elongated threaded body 58 adapted to fit into a threaded opening in the spindle 52. The plug 56 includes a bore 59 and an opening 60 located in the hexagonal head 57 so that a wire can be inserted therethrough. The wire is held in place in the plug 56 by means of the cylindrical block 62 that is sized to fit with the bore 59. The block includes an axial opening therein through which the wire is inserted. A humped portion 63 is provided on the outer end of the black 62 over which the wire is bent. A second opening is provided which extends part way through the block 62, and as shown in FIG. 4 the end of the wire is inserted into that second opening. It has been found that this arrangement maintains the wire in place and prevents it from breaking when the plug 56 is screwed into the spindle 52 at a distance which will create the proper tension in the wires 42, 44. The cylindrical block 62 is separated from the inner surface of the hexagonal head 57 by means of the spacers 68 and the bearing means 70. By using such a plug 56 to attach the wires 42, 44, to the spindles 52 a very simple connecting mechanism is provided which allows the wires to be removed or attached very quickly and which enables a proper tension to be maintained in the wires simply by screwing or unscrewing the plug 56.

Referring again to FIG. 3, the wires 42, 44, extend from the spindle 52 into the well 20 of the machine and through the well across to the other side of the machine, where they are attached to the spindle on that other side. As will be discussed in detail below, the spindle provides the wires with an outer orbital motion. Due to the nature of the folding and planting movement of the wires, this motion must be translated into a non-orbital motion so that the wires will move along their proper paths within the well.

Figure 5:
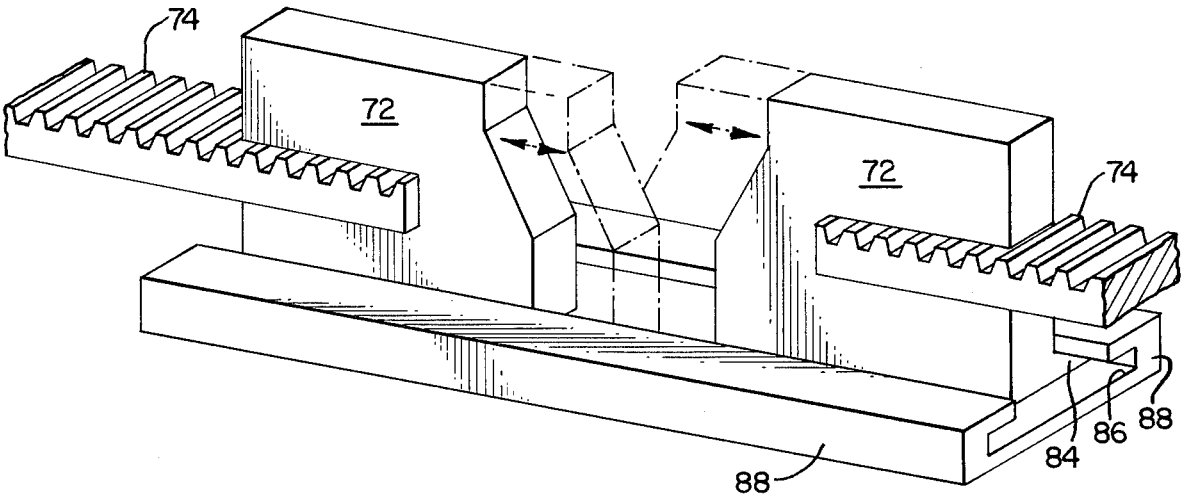
FIG. 5 is a perspective view of the movable guides, showing them in their fully extended position, with the dotted lines showing them in their closed positions.

This translation or guiding effect is provided by a pair of movable guides, designated generally by reference numeral 72, located at each end of the well 20. The guides 72 are designed so that they can both be moved simultaneously in cooperating fashion. As best shown in FIGS. 3 and 5, the guides 72 are each connected to a rack 74 which in turn engages a pinion gear 76 that is driven by a stepping motor 78 through the belt 80. The pair of rollers 82 insure that the racks move along a predetermined line. The dotted lines shown in FIG. 5 show the innermost positions of the guides 72 relative to each other, while the solid lines show their outermost positions. As shown in FIG. 5, each of the guides 72 is provided with a foot portion 84 which engages the groove 86 located in the guide block 88 for maintaining the guides 72 in proper alignment as they are moved back-and-forth.

Figure 6A:
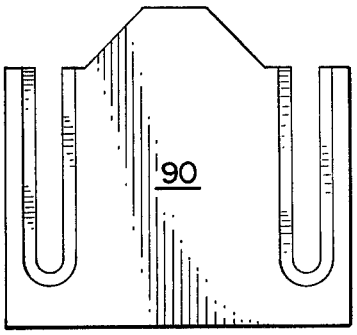
FIG. 6A is a front plan view of one of the stationary cam surfaces.

As shown best in FIG. 6, at each end of the well 20 stationary cam surfaces such as the cam block 90 and the cam pin 92 are provided. The cam block 90 is located below the upper surface of the well 20 and is connected to the machine by means of the bolts 91 (see FIG. 3). As shown in FIG. 6A, the cam block 90 includes a stepped upper surface to guide the wires as will be described in detail below. The cam pin 92 is located above the well 20 between the comb roller 38 and the top surface of the well 20 and engages the wires in such a way as to prevent them from interfering with movement of the yarn.

The cam block 90 should be formed of a material softer than the wires 42, 44, but must be hard enough so that it will not wear excessively due to contact with the wires. Bronze is a material that has been found to be suitable. The cam pin 92, on the other hand, can be formed of steel because it engages the wires with a minimal amount of frictional contact.

Now, the paths along which the portions of the wires 42, 44, that engage the yarn will now be described in detail in connection with FIGS. 7–19. The detail shown in FIG. 2 and the orbital movement of the wires have been eliminated for better understanding of the folding and planting movement. Later, FIGS. 20–32 will be described which show the relative positions of the wires as shown in FIGS. 7–19, respectively, in conjunction with the positions of the cam surfaces and the relative positions of the wires around their orbital path.

Referring now to FIG. 7, the incremental steps of the backing material 10 have been marked on both sides of the well 20. These steps serve to show the relative positions of the planted portion of the yarn as it moves down into the well during the folding and planting cycle. Numeral 1 shows where the wire is planted on both sides of the well while the other numerals illustrate where the previously planted portions of the yarn are located while a subsequent planting step takes place. The hatch marks illustrate that a complete planting cycle can be broken down into six incremental steps of the backing material.

As shown in FIG. 7, the wire 42 is shown as a black wire and the wire 44 is shown as a white wire so that they can be followed easily during the following discussion. In FIG. 7, the wire 42 is shown in its planting position at Step 1 on the right-hand side of the well. At this phase of the cycle, the wire 44 is located above the well and in a position so as not to interfere with the yarn while the wire 42 is planting the yarn. After the planting has taken place, and while the yarn and backing material remain stationary, the wire 42 begins to move out of its planting position as shown in FIGS. 8 and 9. As shown in FIG. 10, the wire 42 continues to move out of the planting position while the wire 44 is beginning to move down toward its planting position. At the same time the backing material has begun to move down into the well as shown by the arrows 94 so that the planted portion of the yarn which was shown in Step 1 in FIG. 7 is now at Step 2 as shown in FIG. 10. In FIG. 11, the wire 42 continues to move away from the well 20 while the wire 44 continues to move toward the well 20, with the backing material now moved to a position where the planted portion of the yarn which was at Step 2 in FIG. 10 is now at Step 3 as shown in FIG. 11. In addition, slack is created in the yarn, as shown by the arrow 96, to prevent the wire 44 from pulling the previously planted portion of the yarn out of the PVC. As shown in FIG. 12, the wire 42 is in its ultimate upward position so as not to interfere with the next planting step. The wire 44 is continuing to move downward and more slack is created in the yarn to prevent the previous planted portion from being pulled out of the PVC. The backing material has moved to the position where the previously planted portion of the yarn is now at Step 4 in the well. At this point, the yarn has had enough slack created in it to momentarily drop out of contact with the wire 44 and fall downward toward the previously formed planted portion. However, between the steps shown in FIGS. 12 and 13, the wire 44 will have caught up with the yarn and will push it into the PVC at the left-hand side of the well at Step 1 as shown in FIG. 13.

Referring now to FIG. 14, the planted portion of the yarn is still at Step 1 at the left-hand side of the well 20 and the wire 44 has begun to move upward away from its planting position. The wire 42 still remains stationary in its upper out-of-the-way position. As shown in FIG. 15, the wire 42 continues to move away from its planting position. Now, referring to FIG. 16, the backing layers have begun to move into the well as shown by the arrows 94 and the previously planted portion of the yarn at the left-hand side of the well is now at Step 2. At this point, as the wire 44 continues to move upward, the wire 42 begins its downward movement toward its planting position.

This sequence continues in FIGS. 17 and 18 where the yarn begins to be moved as shown by the arrow 96 to create slack while the wires 42 and 44, respectively, continue their downward and upward movements. When the wires 42, 44, reach the positions shown in FIG. 18 the backing layers have moved to the point where the previously planted portion of the yarn at the left-hand side of the well is now at Step 4. Enough slack has been created in the yarn between FIGS. 18 and 19 so that it will fall away from the wire 42 toward the previously planted portion of the yarn, and as the wire 42 moves toward its planting position shown in FIG. 19 it will catch up with the yarn and push it into the PVC at the right-hand side of the well at Step 1. At this point, shown in FIG. 19, one cycle of the folding and planting process has been completed and the machine is once again ready to repeat the operation shown in FIGS. 7–19.

Now, referring to FIGS. 20–32, the relative positions of the wires 42, 44, in their orbital and non-orbital positions will be shown in the same sequence as was shown in FIGS. 7–19, respectively, along with the movement of the portions of the wires that engage the yarn in conjunction with both the stationary and movable cam surfaces. The positions of the wires in their orbital paths will be designated by reference numberals 42A and 44A, while the positions of those same wires along the portions of their lengths that engage the yarn (as shown in FIGS. 7–19) will be designated by numerals 42, 44, respectively.

Figure 20:
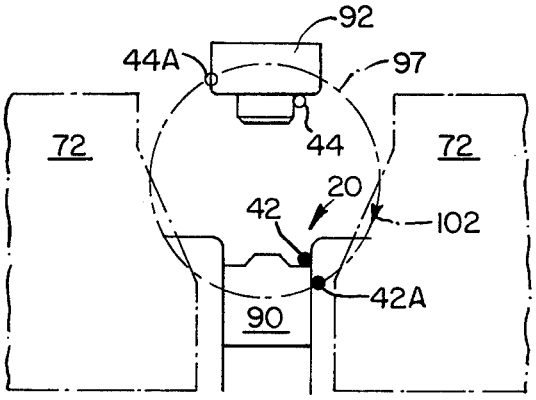
FIGS. 20–32 are schematic views of the wires through one folding and planting cycle, showing the relative positions of the wires moving through their orbital paths and non-orbital paths and the positions of the movable and stationary cam surfaces.
Figure 21:
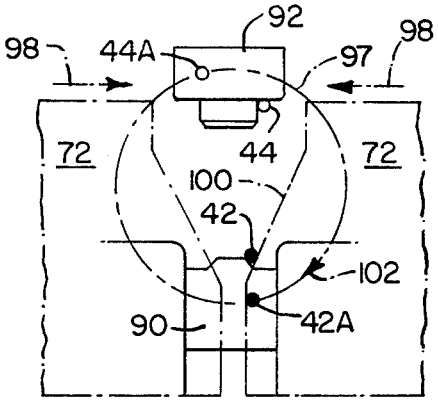

FIG. 20 shows the wires 42, 44, in the position shown in FIG. 7. At this point, the guides 72 are in their outer positions where they do not engage the wires 42, 44. The wire 42 is shown in its planting position at the right-hand side of the well 20, where it is held in place by means of the cam surface 90. The outer end of the wire designated by numeral 42A is shown in its position along the orbital path 97. The portion 42A of the wire 42 can be located so that it engages the stationary cam surface 90 with just enough of a horizontal vector in the direction of the right-hand side of the well 20 to push the yarn into the PVC far enough to plant the yarn therein without pressing against the right-hand wall of the well. With the wires 42A and 44A being spaced 180° apart in the single spindle, the stationary cam surface 92 is used to hold the wire 44 in the position shown in FIG. 20 so that it will not interfere with the yarn 26 which is generally located along the center line of the well 20. Thus, as shown in FIG. 20, the wire 44A is positioned along the orbital path 97 to the left of the center line of the well 20, while the stationary cam surface 92 holds the portion of the wire 44 that engages the yarn on the right-hand side of that center line. Now, referring to FIG. 21, the spindle begins turning in a clockwise direction as shown by the arrow 102 so that the outer portions 42A, 44A, of the wires are moved to the positions shown along the orbital path 97. At the same time the movable guides 72 have begun moving toward each other as illustrated by the arrows 98. This results in the sloping cam surface 100 of the guide 72 on the right-hand side of the well engaging the wire 42 and moving it away from its planting position, the wire also engaging the upper surface of the stationary guide 90 and moving along it to the position shown in FIG. 21. In this way, the wire 42 is moved out of the planting position without interfering with the yarn which is planted in the PVC coating on the right-hand side of the well.

Figure 22:
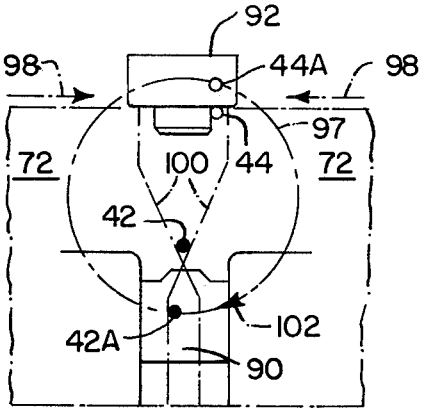

As shown in FIG. 22, the spindles continue to move in a clockwise direction as illustrated by the arrow 102 and the movable guides continue to move toward each other as illustrated by the arrows 98. This cooperating movement results in the wire 42 engaging the sloped surface 100 of the guide 72 on the left- hand side of the well 20 at the same time it engages slope 100 of the guide 72 on the right-hand side. This results in the wire 42 being lifted upward away from the upper surface of the stationary cam 90. The sloped contour of the upper surface of the stationary cam 90 guides the wire 42 and helps provide a smooth transition from horizontal to upward movement. Although the outer portion of the wire 44A is moved in the direction of the arrow 102, the inner portion of the wire 44 still remains stationary as shown in FIG. 22.

Figure 23:
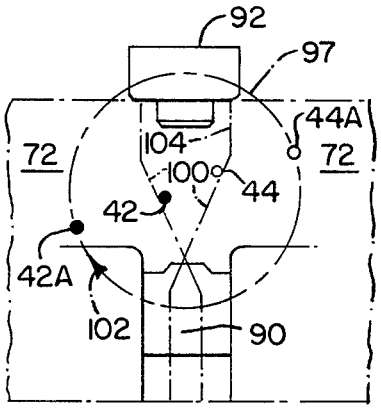
Figure 24:
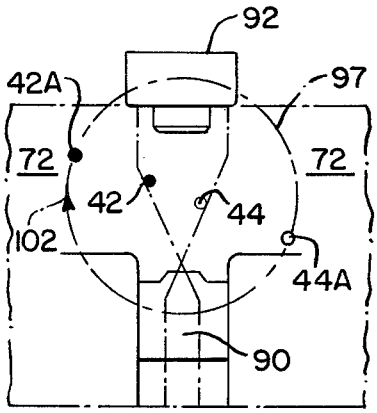

As shown in FIG. 23, the movable guides 72 remain in the positions shown in FIG. 22 while the spindles continue to move in the direction of the arrow 102. As shown, the wire 42 is engaged only by the sloped cam surface 100 at the left-hand side of the well 20 and continues to move upward away from its planting position. The wire 44 is now moving downward along the vertical cam surface 104 of the movable guide 72 at the right- hand side of the well 20 toward its planting position. As shown in FIG. 24, the movable guide 72 has remained in the same position while the spindle continues to move the wires 42A, 44 A, in the direction of the arrow 102. The inner portions of the wires 42, 44, continue to move in the same directions as was just described in conjunction with FIG. 23.

Figure 25:
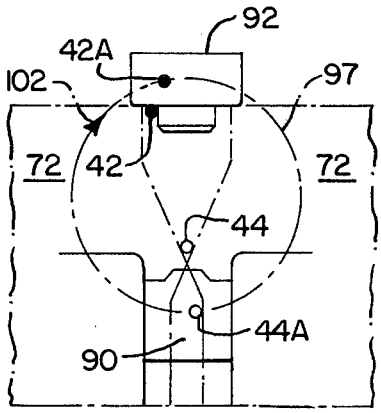

In FIG. 25, the movable guides 72 are still in the same positions and the spindle has moved the portions of the wires 42A, 44A, farther in the direction of the arrow 102. In this figure the wire 42 has engaged the stationary cam surface 92 and is in its uppermost position. It will remain there even though the outer portion of the wire 42A will continue to move clockwise. Wire 44 now engages the surface 100 of both of the movable guides 22 and is poised and ready to plant the yarn in the PVC in the left-hand side of the well 20.

Figure 26:
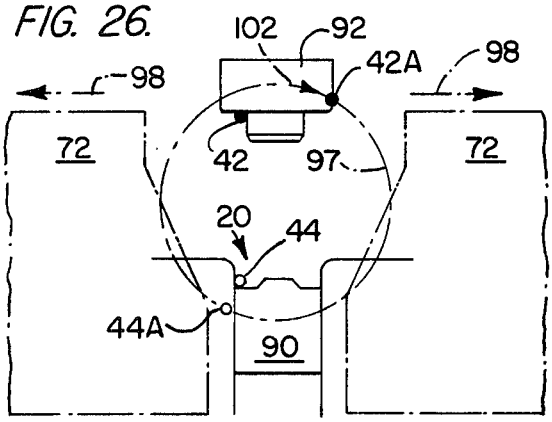
Figure 27:
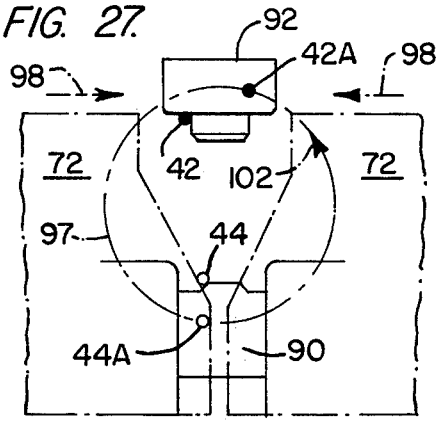
Figure 28:
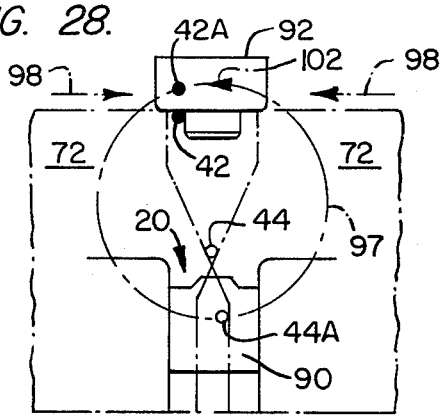
Figure 29:
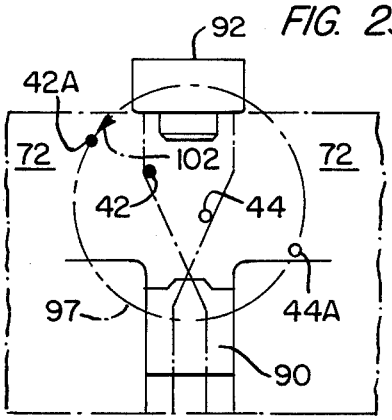
Figure 30:
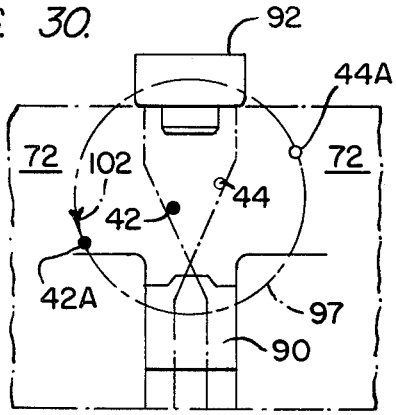
Figure 31:
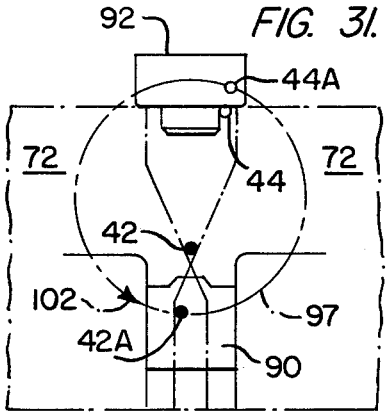

Referring now to FIG. 26, the movable guides 72 have been moved back to the position shown in FIG. 20, which enables the wire 44 to move downward in contact with the upper surface of the stationary cam 90. As the spindle continues to move clockwise, the wire 44 will then be guided into its planting position by the cam surface 90, as shown in FIG. 26. At this point the wires are in their positions shown in FIG. 13 and half of one complete folding and planting cycle has been completed.

Figure 32:
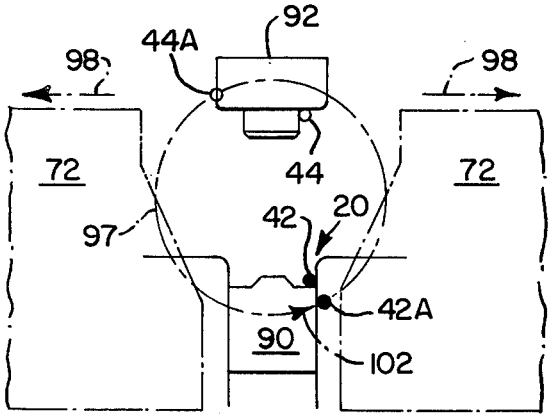

FIGS. 27–32 show the same movement of the outer portions of the wires 42A and 44A shown in FIGS. 21–26, respectively, but in the reverse direction, as illustrated by the arrow 102. The movable guides 72 move in the same sequence, but the positions of the wires 42, 44, are reversed. As shown in FIG. 32, the wires 42, 44, will return to their positions shown in FIG. 20 and plant the yarn in the PVC on the backing material on the right-hand side of the well 20. This completes one full cycle of the folding and planting operation.

Figure 33:
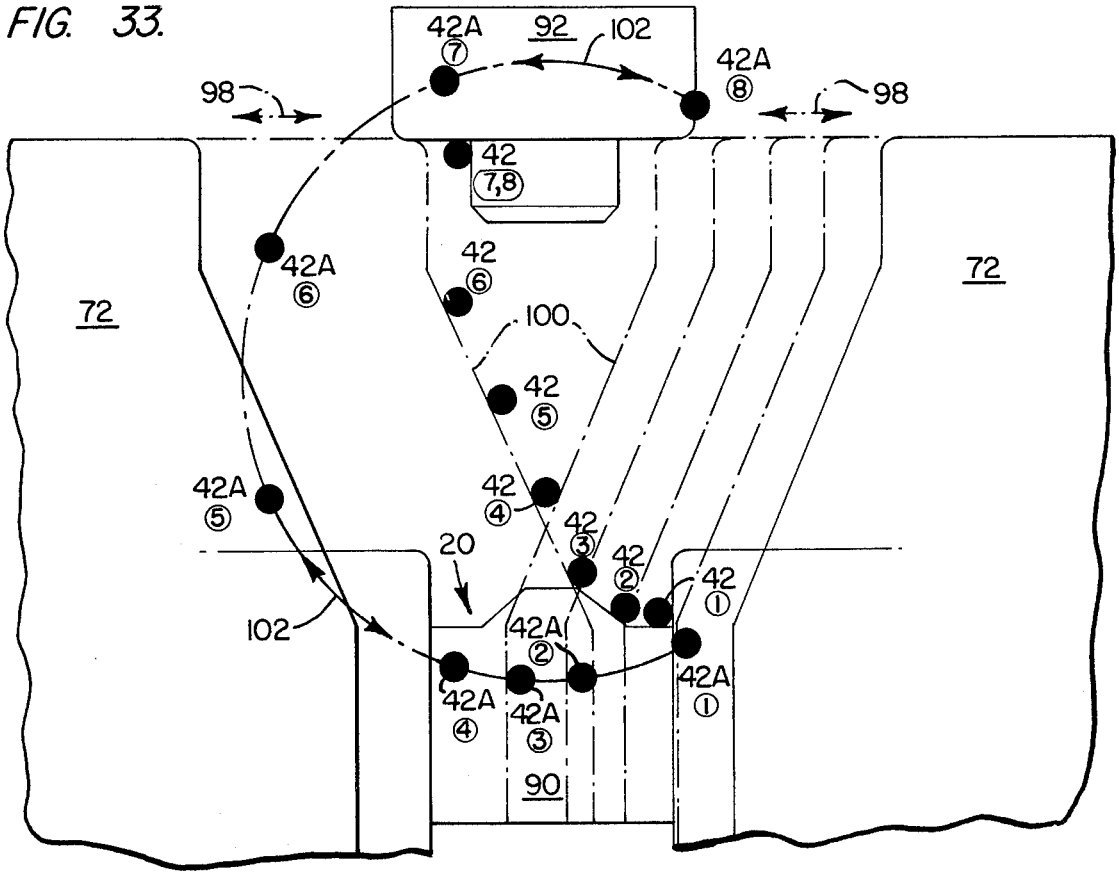
FIG. 33 is a schematic view showing the relative positions of one wire and the cam surfaces of the stationary and movable guides through one folding and planting cycle.

In order to provide a better understanding of the relative movements of the inner and outer portions of the wires and the movable guides in conjunction with the stationary cam surfaces, the path of movement of only the wire 42 through one cycle is shown in FIG. 33. The arrow 98 illustrates the back- and-forth movement of the movable guides 72, whereas the arrow 102 shows the clockwise and counter-clockwise orbital movement of the spindle that moves the outer ends of the wire 42A.

FIG. 33 divides the movement of the wire 42 into eight steps, however, it should be noted that the time sequence and speed of the wire between each step may not be equal. Each step is designated by the circled number beneath the reference numeral 42. The same circled step number for wires designated by the numeral 42A is used to illustrate the relative positions of the inner and outer portions of the same wire at each step during the cycle.

Step 1 reflects the position of the wire 42 as the yarn is being planted in the PVC at the right-hand side of the well 20, as shown in FIGS. 7 and 20. Step 2 shows when the sloped cam surface 100 of the movable guide 72 at the right-hand side of the well moves and engages the wire 42 and pushes it away from its planting position and along the upper horizontal surface of the stationary cam member 90. Step 3 shows a continuation of this movement along the sloped portion of the upper surface of the cam member 90. Step 4 shows that the wire 42 is engaged by the sloped cam surface 100 of both of the movable guides 72 and lifted out of the well 20. At this point, because of the continued clockwise orbital movement of the spindle the wire 42 will disengage from the sloped cam surface 100 of the guide 72 on the right-hand side of the well, as shown in Step 5, and is in engagement with only the sloped surface 100 of the movable guide 72 at the left-hand side of the well. Steps 6 and 7 shown the continued upward progression of the wire 42.

Figure 34:
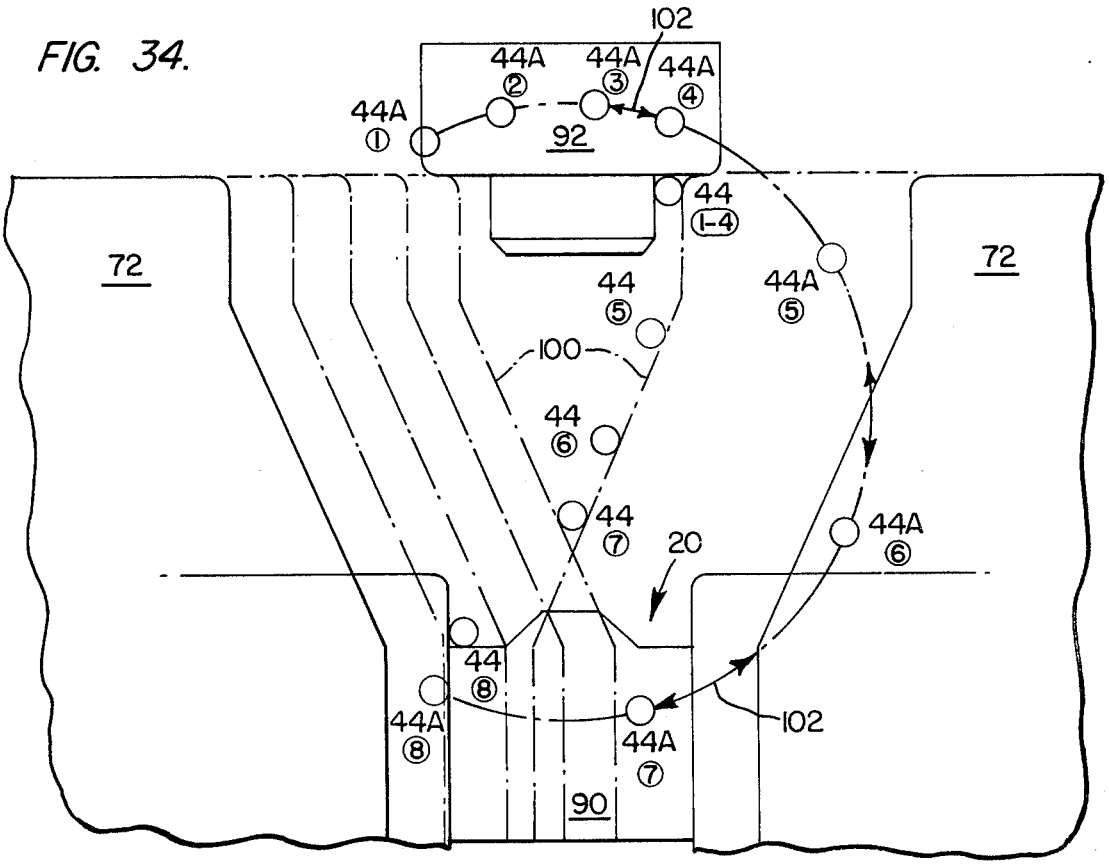
FIG. 34 is a schematic view showing the relative positions of the other wire and the cam surfaces of the stationary and movable guides through one folding and planting cycle.

It should be kept in mind that while the wire 42 is moving along the path shown in FIG. 33, the wire 44 is moving downward toward its planting position as shown in FIG. 34. The same step numbers assigned to the wire 42 are assigned to the wire 44 so that the FIGS. 33 and 34 can be considered together to determine their relative positions at each step. It will be seen that the Steps 1 and 3–8 correspond generally to the sequential movement of the wires as shown in FIGS. 7–13 and 20–26. Step 2 was added to show the progression of movement of the wires along the upper surface of the stationary cam member 90.

It also should be noted that the distances along the orbital path 97 between the steps as shown in FIGS. 33 and 34 are not identical to each other. This is because the progression of movement of the wires 42, 44, was divided into steps with varying time sequences between them in order to present a better picture of the wire movement.

As was mentioned above, all of the moving parts of the machine are powered by stepping motors controlled by a central computer. These stepping motors are known in the art and provide reversible incremental movement to each of the moving parts.

One example of a timing sequence which can be used to operate the machine through the centrally synchronized stepping motors, as described above, be given through one half of the folding and planting cycle as shown by Steps 1–8 in FIGS. 33 and 34. The one half cycle can be divided into 600 time units. If the time sequence starts at zero the stepping motors that operate the spindle turn it in the clockwise direction shown in FIGS. 33 and 34 continuously between 50 units and 600 units. The time unit at each step could be as follows: 1—from 0 to 50 units, 2—at 100 units, 3—at 125 units, 4—at 200 units, 5—at 250 units, 6—at 350 units, 7—at 475 units, and 8—at 600 units. Using the same time unit breakdown, the stepping motors that control the movable guides 72 will begin moving them from their outermost positions toward each other beginning with the 50th unit and ending at 150 units, when they will be in the innermost positions shown in FIGS. 33 and 34. They will remain in that position unitl time unit 475 and will begin to move outward until time unit 575 when they will have reached their outermost positions again. Within the scope of the program described above, each step of the guides shown by the broken lines in FIGS. 33 and 34 represents 25 units.

As shown in FIGS. 7–19 the advancement of the backing layers must also be coordinated with the movement of the wires. The stepping motors that drive the rollers 14 and 17 should advance the backing layers between time unit 300 and time unit 550. Finally, the yarn must be advanced in cooperation with the other elements of the machine and this is done by rotating the stepping motors that control the rollers 32, 34 and 36 and the comb roller 38 between time unit 390 and time unit 600. These stepping motors do not necessarily operate at constant rotational velocity and generally during their movement begin with a rapid acceleration to a relatively high rotational velocity which levels off to a lower rotational velocity. This explains why the distances of the wires 42, 44, along the orbital path 97 between different steps, as shown in FIGS. 33 and 34, do not reflect equal distances for the same number of time units around the entire orbital path 97. It should also be kept in mind that the above program is not the only one which can be used to operate the bonded carpeting machine as described above, but is one that has been found workable and was used merely to illustrate the operation of the invention.

Thus, there is provided as directed in detail above an apparatus for moving and guiding a pair of elongated members or wires in such a way as to enable them to form an accordion-like chain of strands of flexible material in order to produce bonded carpeting. The wires are connected to a single spindle at each end of the machine so that both wires move simultaneously along an orbital path. This feature eliminates complicated structure needed to enable both wires to move independently of each other. In addition, the utilization of stationary cam surfaces in conjunction with movable cam surfaces to translate the orbital movement of the outer ends of the wires into the folding and planting movement enable the orbital movement of the wires to be translated into the non-orbital folding and planting movement faster than in previous versions of such apparatus. The net result of the above is that a simpler and less expensive machine is provided for forming non-woven bonded carpeting at a rate faster than heretofor believed possible and at a lower cost.

The embodiment of the invention described above is intended to be merely exemplary and those skilled in the art will be able to make modifications and variations to it without departing from the spirit and scope of the appended claims. All such modifications and variations are contemplated as falling within the scope of the claims.

I claim:

1. Method for folding a plurality of strands of flexible material to make non-woven bonded carpeting, comprising the steps of:

1. simultaneously moving the portions of a pair of elongated bendable members on both sides of the strands of flexible material along first predetermined paths,
2. translating the movement of said elongated bendable members first predetermined paths to second predetermined paths in the portion of said members that engage the plurality of strands and fold them back and forth to form a series of loops therein,
3. advancing the series of loops and the plurality of strands,
4. bonding the ends of the loops in a fixed position relative to each other.

2. The method in claim 1, wherein the step of simultaneously moving comprises the step of rotating said portions of said members back and forth through an arc of less than 360°.

3. The method in claim 2, wherein the step of rotating includes rotating said members along the same arc.

4. The method in claim 1, wherein the step of translating includes the step of selectively moving a pair of cam surfaces into the first predetermined path to engage and guide the members along a portion of their second predetermined paths.

5. The method in claim 1, wherein the step of translating includes locating a stationary cam surface in a portion of the first predetermined paths to engage and guide the members along a portion of their second predetermined paths.

6. The method in claim 1, wherein the step of translating includes locating a stop in a portion of the first predetermined paths to engage and prevent the strands from moving further along said first predetermined paths.

7. The method in claim 1, wherein the step of bonding includes the step of precoating an advancing web of backing material with a curable adhesive, planting the loops in said adhesive, and curing said adhesive after the loops are planted therein.

8. Apparatus for moving a pair of elongated bendable members, to engage and fold a length of flexible material into a series of loops, comprising moving means for moving both elongated members simultaneously on each side of the flexible material along first predetermined paths, translating means for translating the movement of the portion of each elongated member that engages the flexible material from its predetermined path to a second predetermined path so that the elongated members will alternately engage the flexible material and urge it back and forth to form the series of loops.

9. The apparatus in claim 8, wherein the moving means includes means for holding each elongated member in tension.

10. The apparatus in claim 8, wherein the moving means includes holding means on each side of the flexible material for holding the ends of the elongated members, and motor means for moving the holding means.

11. The apparatus in claim 10, wherein the holding means includes a housing and further includes a spindle adapted for rotational movement within said housing.

12. The apparatus in claim 11, wherein both elongated members are connected to the spindle at an equal distance from the axis thereof.

13. The apparatus in claim 12, wherein the elongated members are connected to the spindle means 180° apart from each other.

14. The apparatus in claim 10, wherein the motor means includes a reversible stepping motor.

15. The apparatus in claim 10, wherein the holding means includes connecting means for connecting the elongated members to the holding means.

16. The apparatus in claim 15, wherein the connecting means includes an inner surface with an opening therethrough adapted to receive an elongated member.

17. The apparatus in claim 16, wherein the connecting means includes a plug with an axial opening adapted to receive the elongated member, the outer surface of the plug including a second opening therein adapted to receive the end of the elongated member.

18. The apparatus in claim 17, wherein the plug includes a convex rounded portion on the outer surface thereof between the axial and second openings.

19. The apparatus in claim 17, wherein the plug is adapted for rotational movement within the connecting means and bearing means is located between the plug and the inner surface of the connecting means.

20. The apparatus in claim 8, wherein the translating means includes a stationary cam surface located within a portion of the first predetermined path for engaging and guiding the elongated members along a portion of their second predetermined paths.

21. The apparatus in claim 20, wherein a separate stationary cam surface is located on both sides of the flexible material.

22. The apparatus in claim 8, wherein the translating means includes a stationary member located within a portion of the first predetermined path for engaging and preventing the elongated members from continuing their movement along the first predetermined path.

23. The apparatus in claim 22, wherein a separate stationary member is located on both sides of the flexible material.

24. The apparatus in claim 8, wherein the translating means includes movable cam surfaces adapted for movement into said first predetermined paths for engaging and guiding the elongated members along a portion of their second predetermined paths.

25. The apparatus in claim 24, wherein the movable cam surfaces include a pair of plates adapted for sliding movement toward and away from each other, the plates each including a surface of predetermined shape for engaging and guiding the elongated members.

26. The apparatus in claim 25, wherein the translating means includes a reversible stepping motor connected to each plate for simultaneously moving the plates toward and away from each other at predetermined intervals.

27. The apparatus in claim 26, wherein the translating means includes rack and pinion means for connecting the reversible stepping motor to each plate.

28. The apparatus in claim 1, wherein the elongated members comprise a pair of flexible wire-like members.

* * * * *